US006364336B1

(12) United States Patent
Jenkins

(10) Patent No.: US 6,364,336 B1
(45) Date of Patent: Apr. 2, 2002

(54) ROWBOAT/CANOE TRANSPORT DEVICE

(76) Inventor: Gregory S. Jenkins, 1032 New Pear St., Vineland, NJ (US) 08360

( * ) Notice: Subject to any disclaimer, the term of this patent is extended or adjusted under 35 U.S.C. 154(b) by 0 days.

(21) Appl. No.: 09/661,233

(22) Filed: Sep. 13, 2000

(51) Int. Cl.[7] ..... B60P 3/10

(52) U.S. Cl. ..... 280/414.2; 280/47.331; 410/97

(58) Field of Search ..... 280/414.1, 414.2, 280/414.3, 47.331; 410/50, 49, 97, 120; 108/55.3, 55.5; 211/87.7

(56) References Cited

U.S. PATENT DOCUMENTS

| | | | | | |
|---|---|---|---|---|---|
| 2,792,232 | A | | 5/1957 | Elmore | 280/47.13 |
| 2,966,368 | A | | 12/1960 | Engnell | 280/179 |
| 2,978,257 | A | | 4/1961 | Barker | 280/179 |
| 3,430,981 | A | * | 3/1969 | Tarantola | |
| 3,687,476 | A | | 8/1972 | Abbott | 280/47.32 |
| 4,392,665 | A | | 7/1983 | Miller et al. | 280/414.2 |
| 4,601,481 | A | | 7/1986 | Maurice | 280/47.13 B |
| 4,824,127 | A | * | 4/1989 | Stamm | 280/47.331 |
| 4,936,595 | A | | 6/1990 | Cunningham | 280/47.331 |
| 5,114,165 | A | * | 5/1992 | Vogel | 280/47.311 |
| 5,203,580 | A | | 4/1993 | Cunningham | 280/47.331 |
| 5,230,526 | A | | 7/1993 | Jolivet | 280/414.2 |
| 5,320,371 | A | | 6/1994 | Levad | 280/204 |
| 5,425,326 | A | | 6/1995 | Tibbedeaux | 114/344 |
| 5,791,279 | A | | 8/1998 | Hart | 114/344 |
| 6,113,327 | A | * | 9/2000 | Schrader | 410/97 |
| 6,142,492 | A | * | 11/2000 | DeLucia | 280/47.331 |

FOREIGN PATENT DOCUMENTS

| | | | | |
|---|---|---|---|---|
| AU | 242250 | * | 1/1963 | 280/414.2 |

* cited by examiner

*Primary Examiner*—Anne Marie Boehler
(74) *Attorney, Agent, or Firm*—Henderson & Sturm LLP

(57) ABSTRACT

A transport device 10 for one end of a flat bottomed rowboat or a canoe with a keel. The device 10 includes a generally flat rectangular support member 20 having a generally flat top surface 22 provided with a central flat bottomed recess 23 dimensioned to receive the keel of a canoe. The top surface 22 of the support member 20 is provided with a resilient high friction coating 24 that will resist the lateral displacement of a canoe or rowboat on the support member 20. The device 10 further includes a wheel and axle assembly 31, 30 and a quick release securing unit 13. The support member is cantilevered relative to the wheel and axle assembly 31, 30 and the wheels 31 are positioned beneath the opposed sides 27, 28 of the support member.

8 Claims, 1 Drawing Sheet

ROWBOAT/CANOE TRANSPORT DEVICE

BACKGROUND OF THE INVENTION

1. Field of the Invention

The present invention relates to the field of wheeled transport devices for small water craft, such as rowboats, canoes, and the like.

2. Description of Related Art

As can be seen by reference to the following U.S. Pat. Nos. 2,792,232; 4,601,481; 4,936,595; 5,425,326; and 5,791,279, the prior art is replete with myriad and diverse wheeled transport devices for canoes and rowboats.

While all of the aforementioned prior art constructions are more than adequate for the basic purpose and function for which they have been specifically designed, they are uniformly deficient with respect to their failure to provide a simple, efficient, and practical way of transporting both rowboats and canoes.

As most fishermen and recreational boaters are well aware, most wheeled transport devices for one type of common personal water craft such as the canoe are usually totally unsuited for the other equally common type of personal water craft, the rowboat.

As a consequence of the foregoing situation, there has existed a longstanding need for a new and improved type of wheeled transport device that is equally adept at transporting either a canoe or a rowboat, and the provision of such a construction is a stated objective of the present invention.

BRIEF SUMMARY OF THE INVENTION

Briefly stated, the transport device for rowboats and canoes that forms the basis of the present invention comprises in general, a support unit, a transport unit, and a securing unit.

As will be explained in greater detail further on in the specification, the support unit comprises an enlarged generally thick, flat, rectangular support member having an upper surface provided with a central flat bottomed recess that is dimensioned to receive the keel of a canoe wherein the upper ends of the central recess are curved and the upper surface of the support member may be optionally provided with a high friction coating to resist the lateral translation of the bottom of the water craft relative to the support member.

In addition, the bottom of the support unit is provided with a downwardly depending stem element that is operatively connected to the transport unit which includes a conventional wheel and axle assembly wherein the wheels are disposed beneath the opposed sides of the enlarged rectangular support member.

Furthermore, the securing unit comprises a quick release mechanism which employs a length of chain connected on one side of the support member and a resilient strap connected on the other side of the support member wherein the free end of the resilient strap is provided with a hook adapted to engage a selected link in the chain to captively engage one end of a canoe or rowboat to the transport device.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
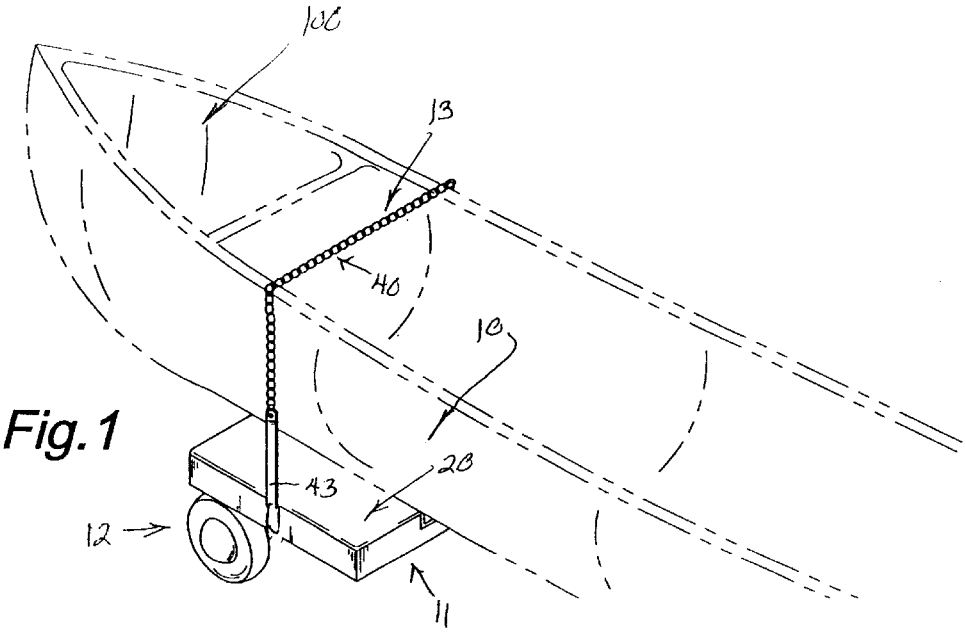
FIG. 1 is a perspective view of the transport device operatively engaged with one end of a canoe.

As can be seen by reference to the drawings, and in particular to FIG. 1, the rowboat/canoe transport device that forms the basis of the present invention is designated generally by the reference number 10. The transport device 10 comprises in general a support unit 11, a transport unit 12, and a securing unit 13. These units will now be described in seriatim fashion.

As shown in FIGS. 2 through 5, the support unit 11 comprises an enlarged generally thick rectangular support member 20 having opposed sides 27, 28, a planar bottom surface 21, and a generally planar upper surface 22 having a centrally disposed square bottomed recess 23 which extends from the front to the rear of the support member 20. The upper edges of the recess 23 are slightly curved and the upper surface 22 of the support member 20 may be provided with a high friction coating 24 such as rubber or the like.

Figure 2:
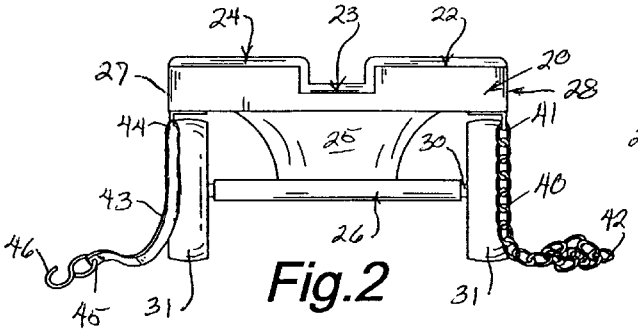
FIG. 2 is an end view of the transport device.
Figure 3:
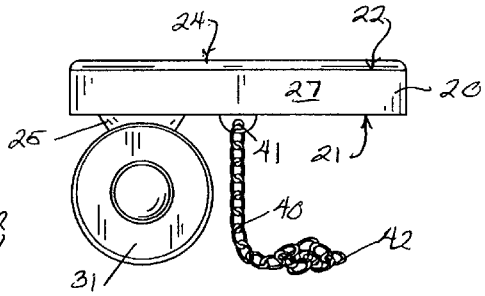
FIG. 3 is a right side view of the transport device.
Figure 4:
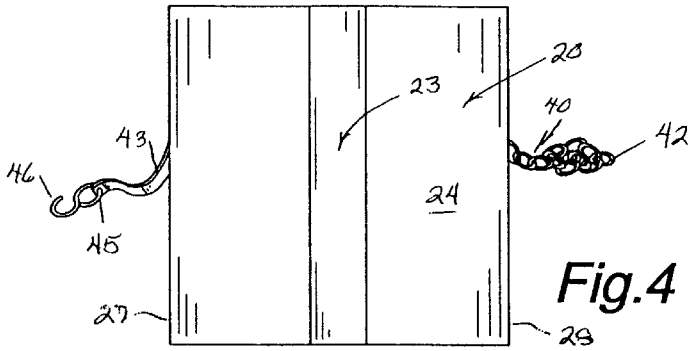
FIG. 4 is a top plan view of the transport device.

Turning now to FIGS. 2 and 3, it can be seen that the bottom surface 21 of the support member 20 is provided with a downwardly depending stem element 25 that is operatively connected in a well recognized fashion to the transport unit 12 which includes an axle member 30 rotatably disposed in the lower portion 26 of the stem element 25. The opposite ends of the axle member 30 are provided with a pair of balloon tires 31 positioned beneath the opposed sides 27, 28 of the support member.

In addition, as can best be seen by reference to FIGS. 1 and 3, the support unit 11 is cantilevered relative to the transport unit 12 for reasons that will be explained in greater detail further on in the specification.

As shown in FIGS. 1 through 4, the securing unit 13 comprises an elongated length of chain 40 having one end 41 secured on one side of the support member 20 and a resilient strap member 43 having one end 44 secured on the other side of the support member 20 wherein the securing unit 13 is disposed across the midpoint of the support unit 11. The free end 45 of the strap member 43 is provided with a hook element 46 that is adapted to releasably engage a selected link on the free end 42 of the length of chain 40 to captively engage one end of a water craft designated generally as 100 to the transport device 10.

At this juncture, it should be noted that it has been determined through trial and error that the effective width and depth of the central flat bottomed recess 23 on the support unit 11 should be 5 inches wide and 2 inches deep to accommodate the keel of most commercially available canoes, kayaks, sea kayaks, row boats, etc. such as to minimize any side to side tipping of the canoe when the keel is inserted into the central recess.

In addition, the generally planar friction coating 24 on the top of the support member 20 will substantially reduce any lateral displacement of a flat bottomed water craft such as a rowboat when the transport device 10 is properly attached to the water craft.

Furthermore, the cantilevered relationship of the support unit 11 relative to the transport unit 12, as well as the placement of the securing unit 13 proximate to the midpoint of the support unit 11, is designed to maintain the support unit 11 in effective frictional engagement with the bottom and keel of a rowboat or canoe.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A transport device for both flat bottomed rowboats and canoes having keels wherein the transport device comprises:

a support unit including a generally enlarged thick, flat, rectangular rigid support member having opposed sides, a bottom surface, and a top surface provided with a flat bottomed central recess that extends from the front to the rear of the top surface of the support member;

a transport unit including a pair of wheels mounted on an axle which is operatively associated wherein the pair of wheels is positioned beneath the opposed sides of the support member with the support member; and, securing means for captively engaging a selected one among a rowboat and a canoe to the top surface of the support member wherein the securing means comprises a length of chain having one end attached to one side of the support member and a resilient strap having a first end attached to the other side of the support member wherein the second end of the resilient strap is provided with a hook element adapted to engage a selected link on said length of chain.

2. The device as in claim 1 wherein the top surface of the support member is provided with a resilient frictional coating.

3. The device as in claim 2 wherein the effective width of the central recess is five inches.

4. The device as in claim herein the effective depth of the central recess is two inches.

5. The device as in claim 1 wherein the width of the central recess is five inches.

6. The device as in claim 5 herein the depth of the central recess is two inches.

7. The device as in claim 1 wherein the upper ends of the flat bottomed recess are slightly curved.

8. The device as in claim 1 wherein the support unit is cantilevered relative to the transport unit.

* * * * *